US006431188B1

(12) United States Patent
Laszczewski, Jr. et al.

(10) Patent No.: US 6,431,188 B1
(45) Date of Patent: Aug. 13, 2002

(54) DISHWASHER SPRAY ARM FEED SYSTEM

(75) Inventors: Richard R. Laszczewski, Jr., Monticello, IN (US); Roger J. Bertsch, Stevensville; Eric C. Irwin, Benton Harbor, both of MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 09/541,267

(22) Filed: Apr. 3, 2000

(51) Int. Cl.[7] ..... B08B 3/00

(52) U.S. Cl. ..... 134/56 D; 134/57 D; 134/58 D; 134/144; 134/180

(58) Field of Search ..... 134/56 D, 57 D, 134/58 D, 144, 172, 174, 179, 180, 183, 201

(56) References Cited

U.S. PATENT DOCUMENTS

| | | | | |
|---|---|---|---|---|
| 4,064,887 A | | 12/1977 | Geiger et al. | 134/144 |
| 5,474,378 A | * | 12/1995 | Smith et al. | 312/334.4 |
| 5,823,211 A | | 10/1998 | Wilhelmstatter et al. | 134/176 |
| 5,904,166 A | * | 5/1999 | Nannt et al. | 134/179 |

FOREIGN PATENT DOCUMENTS

| | | | | |
|---|---|---|---|---|
| EP | 094409 B1 | | 11/1985 | A47L/15/14 |
| EP | 372342 B1 | | 6/1993 | A47L/15/50 |
| EP | 401767 B1 | | 5/1994 | A47L/15/22 |
| EP | 0 772 994 | * | 11/1995 | |
| EP | 0 796 587 | * | 2/1997 | |
| EP | 0872208 A1 | | 10/1998 | A47L/15/50 |
| IT | 021140 | | 9/1990 | |
| IT | MI92U000567 | | 5/1992 | |

* cited by examiner

*Primary Examiner*—Randy Gulakowski
*Assistant Examiner*—Joseph Perrin
(74) *Attorney, Agent, or Firm*—Thomas J. Roth; Robert O. Rice; Joel M. Van Winkle

(57) ABSTRACT

A dishwasher having a wash chamber or tub including a sump and a side wall. A pump is fluidly connected with the sump and a supply tube is supported adjacent the tub side wall and receives wash liquid from the pump, the supply tube has a manifold portion including a plurality of outlet openings. A coupling retainer is connected to the supply tube and has a plurality of funnel shaped coupling ports corresponding in number and spacing to the outlet openings of the supply tube. Each of the coupling ports includes a center opening which is provided with a sealing surface. A valve member supports a plurality of valve elements for sealing the outlet openings and is captured between the coupling retainer and the supply tube such that the valve elements generally align with the coupling ports. At least one adjustable height basket is supported within the tub and a spray arm is associated with the adjustable height basket and has a feed tube extending toward the supply tube. The feed tube has a coupling end wherein the coupling end is insertable into one of the coupling ports for fluidly connecting the feed tube to the supply tube. The coupling end is sealingly engaged by the sealing surface upon insertion into one of the coupling ports and opens the valve element corresponding to the coupling port into which the coupling end is inserted.

14 Claims, 5 Drawing Sheets

DISHWASHER SPRAY ARM FEED SYSTEM

BACKGROUND OF THE INVENTION

1. Field of the Invention

The present invention is directed to dishwashers and more particularly, to dishwasher spray arm feed systems.

2. Description of the Related Art

Modern dishwashers include a tub and an upper and lower rack or basket for supporting soiled dishes within the tub. A pump is provided for recirculating wash liquid throughout the tub to remove soils from the dishes. Typically, larger dishes are carried on the lower rack or basket which is moveable in or out of the tub for loading and unloading. A lower wash arm that rotates about a vertical axis is provided beneath the lower rack. An upper rack is also provided for articles such as cups and glasses, and it is mounted on rollers and tracks to also be moveable in or out of the tub for loading and unloading. It has been found that a single rotary lower wash arm does not always give good washability performance because the spray path can be blocked by dishes on the lower rack and very little water may reach some articles on the upper rack. Therefore, nearly all dishwashers include an upper or second level spray mechanism beneath the upper rack to spray upward directly on the articles in the upper rack and downwardly on to the articles on the lower rack.

Lower spray arms are generally mounted directly above the recirculation pump and receive wash liquid directly therefrom. Different approaches have been taken to rotatably support a lower spray arm and provide a thrust bearing surface. For example, U.S. Pat. Nos. 3,866,837 and 5,427,129 disclose different spray arm bearing support systems.

The upper or second level spray system may include a rotating wash arm similar to the main or lower wash arm which may be mounted directly to the upper rack and receive wash liquid through an upper arm feed system. Different approaches have been taken to feed and rotatably support second level spray arms which are associated with an upper rack or basket. One approach for an upper arm feed system is to utilize a tower mounted to the lower rack which receives wash liquid from the lower spray arm and has an open upper end such that wash liquid is sprayed through the tower upwardly into a bottom inlet in the upper spray arm for supplying the upper arm with wash liquid. U.S. Pat. No. 5,330,102 discloses a center tower type system for feeding an upper spray arm having a bottom inlet.

Another approach to supplying wash liquid to an upper rack spray system is to feed wash liquid to an upper spray arm through a liquid conduit which is mounted on the exterior of the dishwasher tub. U.S. Pat. Nos. 4,172,463, 4,004,600 and 5,211,190 are all examples of this type of approach. Generally, a discharge outlet from the wash pump is provided which is connected to an liquid conduit which is routed along the exterior of the dishwasher tub. The liquid conduit passes through the tub back into the wash chamber in an area near the upper rack to feed wash liquid to the upper spray arm.

The upper spray arm of a dishwasher may also be fed through the use of an internally disposed supply conduit. In such case, the wash pump of a dishwasher may be provided with a discharge outlet for supplying a conduit which extends along the inside surface of the dishwasher tub to a location near the upper dishwasher rack to feed wash liquid to the upper spray arm.

Upper dishracks are often supported in a manner that allows for vertical height adjustment. U.S. Pat. Nos. 5,474,378 and 4,097,099 illustrate adjustable upper rack support systems.

Adjustable upper racks require upper spray arm feed systems which can accommodate the adjustable position of the upper rack. In the past various upper rack feed system designs have been used which can accommodate variable position upper racks. For example, U.S. Pat. No. 5,823,211 discloses a dishwasher having at least one adjustable height rack or basket to which an associated spray arm and inlet tube are secured. The inlet tube is disposed horizontally and is connected by a coupling to a supply line secured to a side wall of the tub. An open connection fitting and two closed blind fittings protrude toward the inlet tube. The coupling has two openings into which the connecting fitting and one of the blind fittings respectively, protrude. The adjustable basket can be moved between an upper and lower position wherein the open connection fitting supplies wash liquid to spray arm associated with the adjustable height rack.

EP 0 401 767 B1 is also directed to a feed system for supplying liquid to a spray arm associated with an adjustable height basket. In this reference, the upper spray arm is equipped with a connecting pipe extending horizontally toward the back wall of the tub and adapted to join up in a detachable fashion with a water supply pipe extending vertically in correspondence with the back wall of the tub. To supply the upper spray arm with wash liquid in each of two vertical positions, the connecting pipe is designed at one end with a box collector extending upward and equipped with two vertically spaced outlets. The collector is provided with check ball type valve means adapted to make the supply pipe communicate only with the outlet of the collector which is coupled with the connecting pipe.

SUMMARY OF THE INVENTION

The present invention provides a dishwasher having a wash chamber or tub including a sump and a side wall. A pump is fluidly connected with the sump. At least one adjustable height basket is supported within the tub. A supply tube is supported adjacent the tub side wall and receives wash liquid from the pump, the supply tube has a manifold portion including a plurality of outlet openings. A coupling retainer is connected to the supply tube and has a plurality of funnel shaped coupling ports corresponding in number and spacing to the outlet openings of the supply tube. Each of the coupling ports includes a center opening which is provided with a sealing surface. A valve member supports a plurality of valve elements for sealing the outlet openings and is captured between the coupling retainer and the supply tube such that the valve elements generally align with the coupling ports. A spray arm is associated with the adjustable height basket and has a feed tube extending toward the supply tube. The feed tube has a coupling end wherein the coupling end is insertable into one of the coupling ports for fluidly connecting the feed tube to the supply tube. The coupling end is sealingly engaged by the sealing surface upon insertion into one of the coupling ports and opens the valve element corresponding to the coupling port into which the coupling end is inserted. Water pressure within the manifold is used to seal the coupling ports which do not receive the coupling end.

DESCRIPTION OF THE PREFERRED EMBODIMENTS

Figure 1:
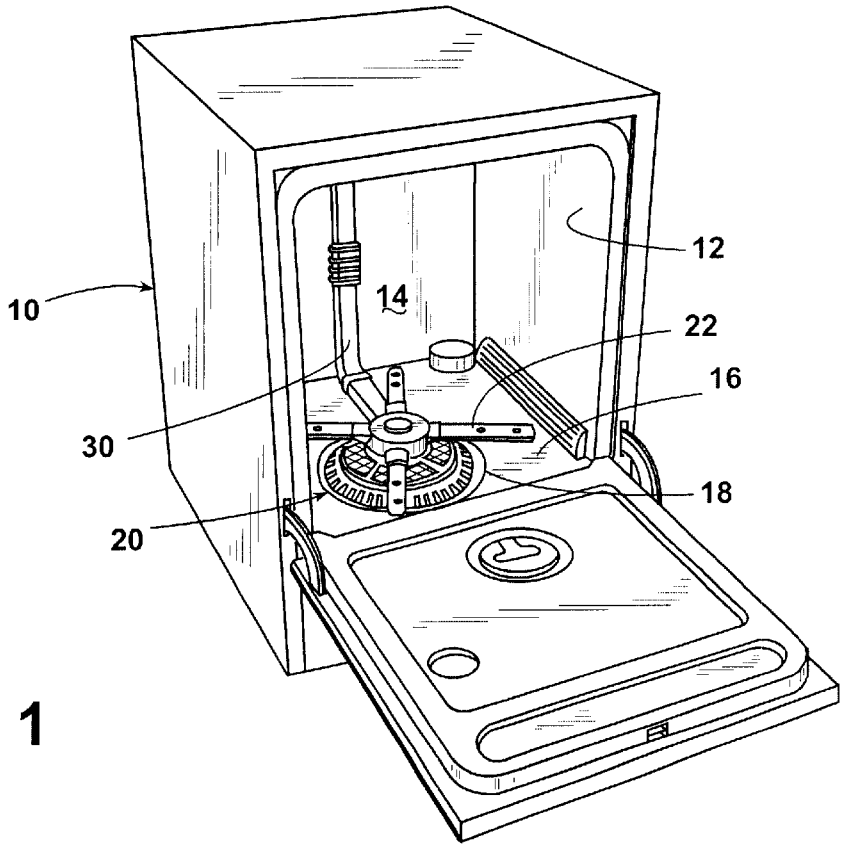
FIG. 1 is a perspective view of a dishwasher including a spray arm system in accordance with the present invention.
Figure 2:
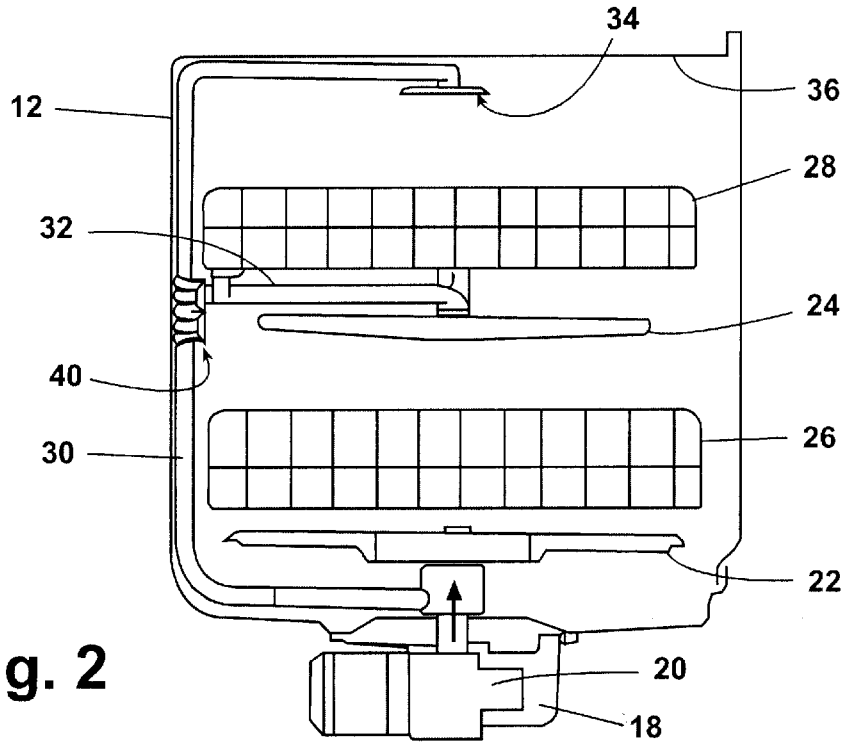
FIG. 2 is a schematic, cross-sectional view of the dishwasher of FIG. 1, showing the dishracks mounted within the tub and the spray arm feed system.

In accordance with the invention as shown in the drawings, and particularly as shown in FIGS. 1 and 2, an automatic dishwasher generally designated 10 includes an interior tub 12 forming an interior wash chamber or dishwashing space 14. The tub 12 includes a sloped bottom wall 16 which defines a lower tub region or sump 18 of the tub. A pump assembly 20 is located in the bottom wall 16 and operates to draw wash liquid from the sump and pump it to a lower spray arm assembly 22, a mid-level spray arm assembly 24 and an upper spray arm assembly 34. The lower spray arm 22 is positioned beneath lower dishware rack 26 and the mid-level spray arm assembly 24 is associated or positioned below an adjustable height dishware rack or basket 28.

The lower spray arm assembly 22 may be mounted to the upper portion of the pump assembly 20 and receive wash liquid from the pump. Since the mid level spray arm assembly 24 and upper spray assembly 34 are remote from the pump, means must be provided to supply wash liquid remotely to these upper spray devices 24 and 34. To that end, a supply tube 30 extends generally rearwardly from the pump assembly 20 to the rear wall of the tub and then runs upwardly to supply wash liquid to upper spray devices 24 and 34.

According to the present invention, the spray arm 24 associated with the adjustable height basket 28 includes a rear feed tube 32 which is fluidly connected with the supply tube 30 through the use of a coupling system 40. The coupling system 40 is designed to couple the supply tube 30 to the feed tube 32 when the adjustable rack 28 is at a plurality of different heights. The coupling system 40 further accommodates a single height coupling arrangement.

Figure 3:
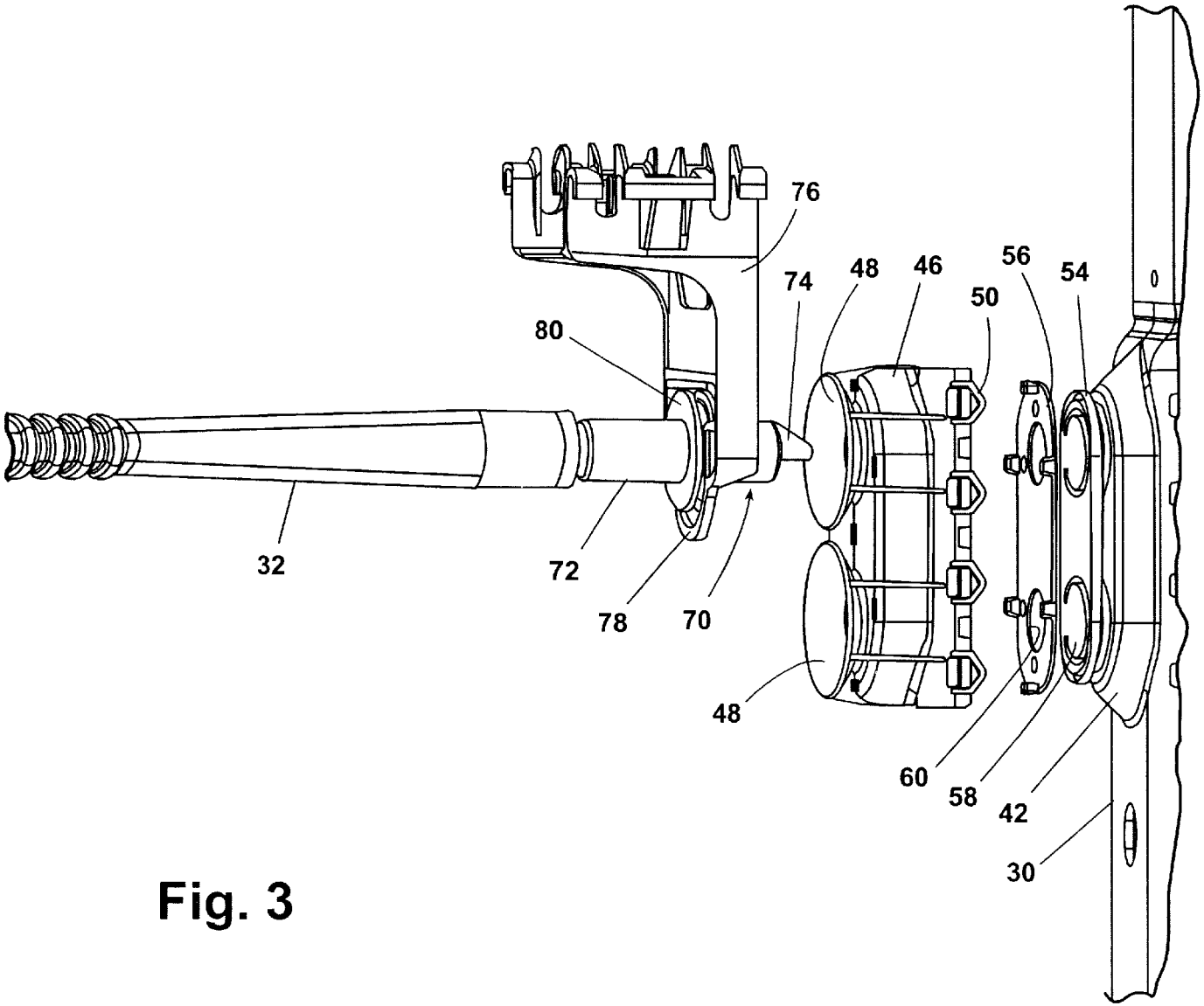
FIG. 3 is a perspective, exploded view of the spray arm coupling system of the present invention including the spray arm feed tube.
Figure 4:
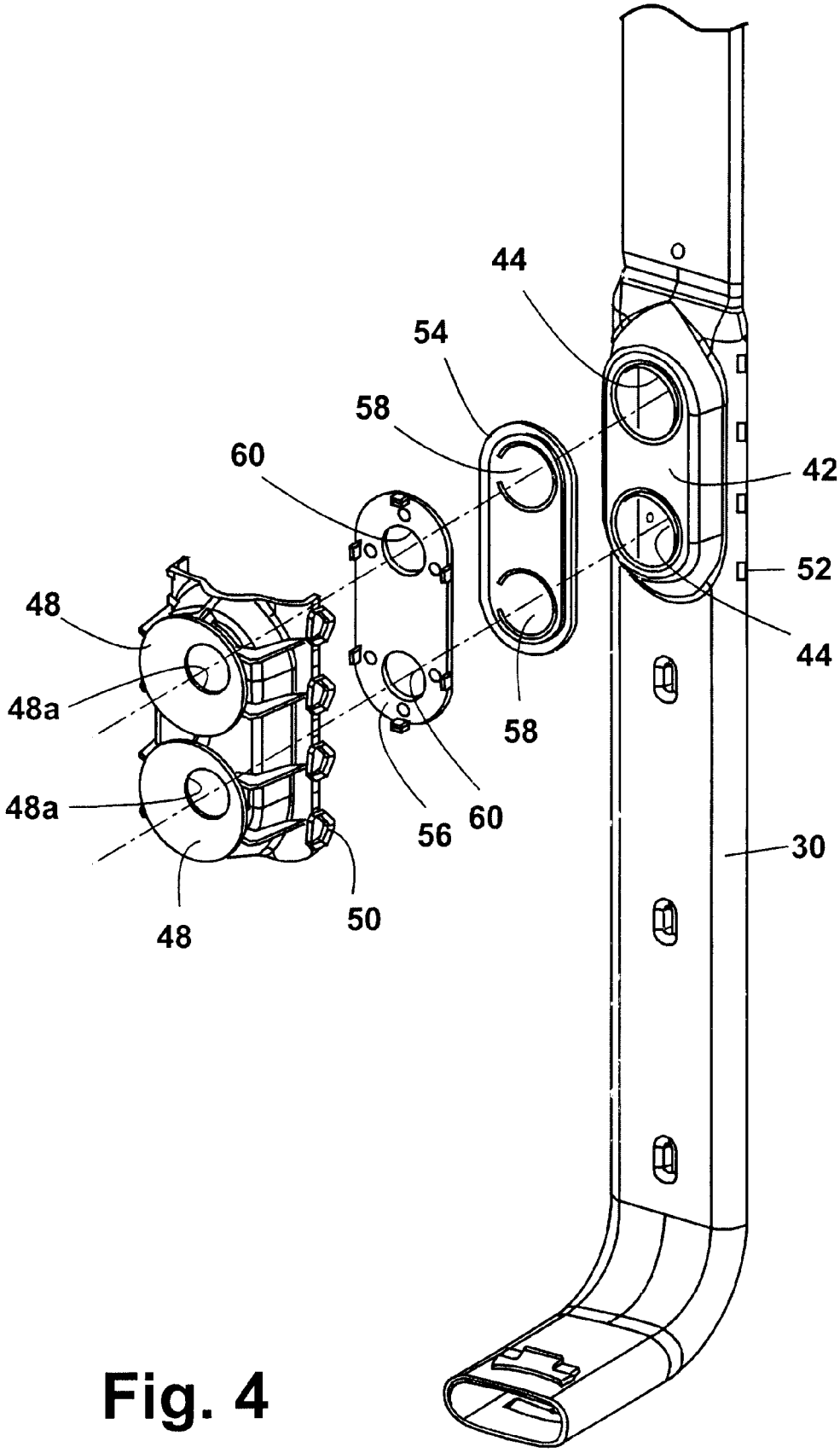
FIG. 4 is a perspective, exploded view of the spray arm coupling system of the present invention, showing the coupling system from a different angle than shown in FIG. 3.

As best seen in FIGS. 3 and 4, the coupling system 40 includes an enlarged portion or manifold 42 formed into the supply tube 30. The manifold portion 42 includes a plurality of outlet openings 44. Two outlet openings 44 are shown in the present embodiment but more outlet openings could readily be provided. In the disclosed embodiment, a coupling retainer 46 is connected to the supply tube 30 in the area of the manifold 42 such that a plurality of funnel shaped coupling ports 48 formed into the retainer 46 are aligned with and overlay the outlet openings 44. The coupling ports 48 include center openings 48*a*. Although the coupling retainer 46 may be connected to the supply tube 30 using any known connection means, in the disclosed embodiment the retainer 46 is snap connected using a plurality of holes or openings 50 which form snap hooks and which are provided on the coupling retainer 46 and snap over a corresponding number of ribs or bumps 52 formed into the manifold portion 42.

The coupling system 40 further includes a valve member 54 and a gasket member 56 which are both captured between the coupling retainer 46 and the manifold portion 42. The valve member 54 includes a plurality of valve elements 58. The valve elements 58 in the disclose embodiment are flapper type elements having generally circular bodies joined to the main portion of the valve member 54 by relatively narrow connecting flex sections. The gasket member 56 includes a plurality of openings 60 which form sealing surfaces. The valve member 54 and the gasket member 56 are positioned between the coupling retainer 46 and the manifold portion 42 in such a manner that the valve elements 58 and the gasket openings 60 are generally aligned with the center openings 48*a* of the coupling ports 48.

While the gasket member 56 is shown as a separate element from the coupling retainer 46, alternatively, the sealing surfaces provided by the gasket member 56 could be integrally formed into the coupling retainer 46. This could be done, for example, using a two step over molding processes. In such a case, the center openings 48*a* of the coupling retainer 46 would be provided with annular sealing surfaces. Accordingly, it can be understood that the center openings 48*a* can be provided with sealing surfaces through either a gasket member 56 or as an integral part of the coupling retainer 46.

The feed tube 32 is designed to fluidly couple to the supply tube via the coupling system 40 and includes a coupling end 70. The coupling end 70 is shown cylindrical but could be formed with other cross-sectional shapes as well. The connecting end 70 of the feed tube 32 may be formed as part of a connecting member 72 which may be formed as a separate member from the main portion of the feed tube 32 as shown in the disclosed embodiment. Alternatively, the connecting member 72 may be formed as an integral part of the feed tube 32. The connecting member 72 includes a probe element or finger 74 extending from the connecting end 70. To securely locate the coupling end 70 of the feed tube 32, a hanging support element 76 engages the dishware basket 28 and includes a U-shaped portion 78 extending downwardly to support the coupling end 70. A slotted flange 80 may be formed onto the connecting member 72 to engage the U-shaped portion 78. When the coupling system 40 is properly assembled together, the coupling ports 48 are oriented such that the coupling end 70 can be inserted thereinto.

Figure 5:
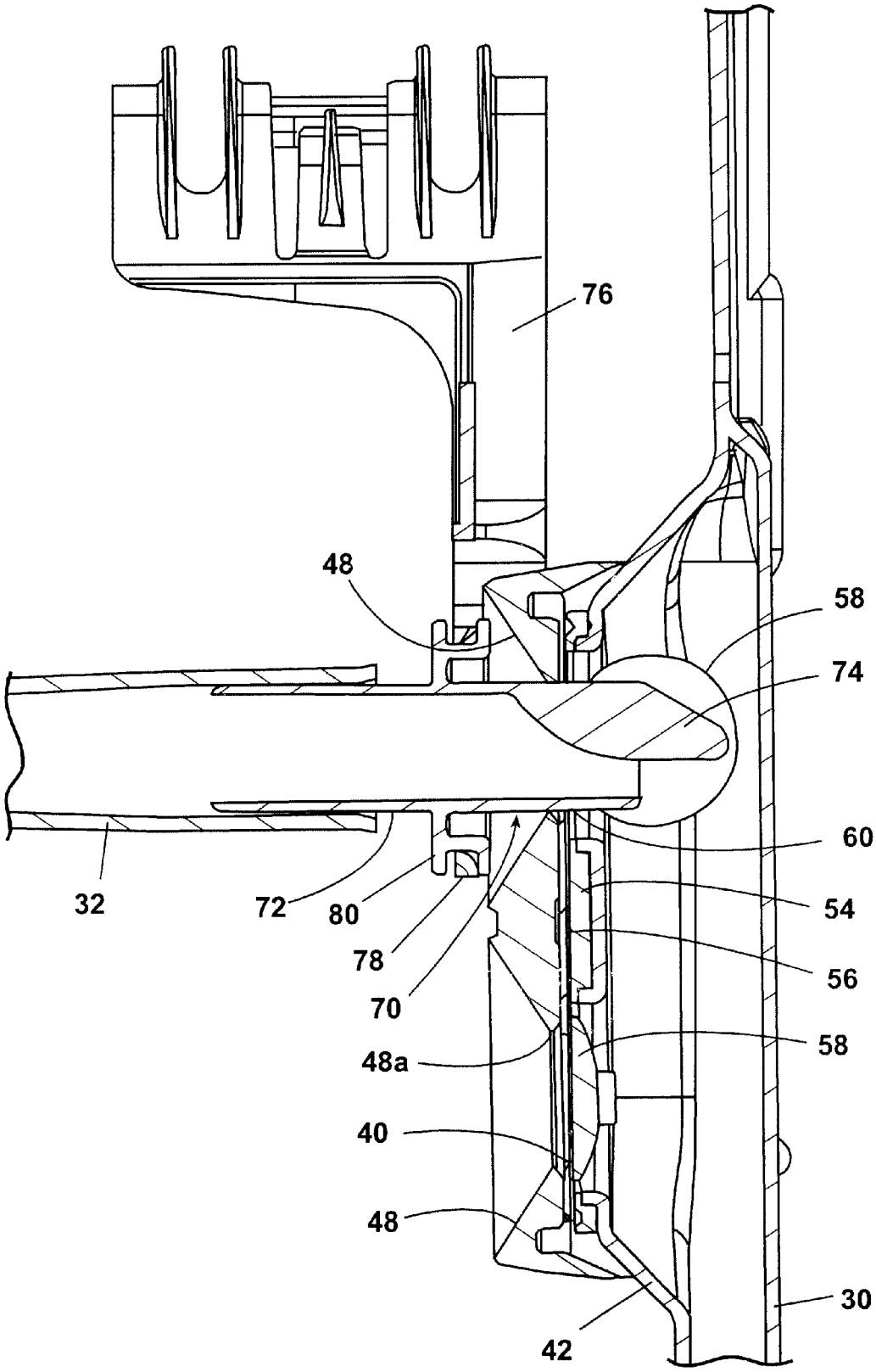
FIG. 5 is a side sectional view of the coupling system of the present invention with the coupling end of the feed tube inserted into the top coupling port.

During operation of the dishwasher, the dishware basket or rack 28 may be pulled out of the tub along guides (not shown) and loaded with soiled dishware. After loading, the dishware rack 28 is thrust into the dishwasher at one of a plurality of selectively adjustable heights. The adjustable height positions of the rack 28 cause the location of the coupling end 70 of the feed tube 32 to align with one of the coupling ports 48. As best seen in FIG. 5, in the process of inserting the rack 28 back into the tub 12, the finger 74 is inserted into the coupling port 48 and causes the valve element 58 to open. Moreover, the cylindrical coupling end 70 inserts into the coupling port 48, through the gasket opening 60 and into the manifold area 42 of the supply tube 30 such that that cylindrical coupling end is sealingly engaged by the gasket opening 60. In this manner, fluid passing through the supply tube 30 is directed into the feed tube 32 through the coupling system 40 such that the wash arm 24 may be supplied with wash liquid.

As can be seen in FIG. 5, any coupling port 48 which does not receive the coupling end 70 of the feed tube 32 is sealed closed by a valve 58. Any valve 58 which is not opened by the coupling end 70 seals against gasket member 56 under the pressure of the wash liquid within the supply tube 30. Moreover, the coupling system 40 is capable of operating wherein all of the coupling ports 48 are sealed closed such as may occur if the rack 28 and associated feed tube 32 is removed. This may be done to wash a particularly large dish item or items.

The present invention contemplates that the outlet openings 44 provided in the manifold portion 42 may be formed in a unique manner such that one, two or more outlet openings 44 can be accommodated using the same tool. In particular, the supply tube 30 may be formed as a blow molded part which includes the manifold portion 42. A plurality of protrusions or closed fittings are molded into the manifold portion 42. The protrusions may then be selectively opened through a secondary operation after the molding of the supply tube 30. The number of openings 44 can be varied to accommodate a single position rack 28 or a rack 28 which is adjustably supported.

Figure 6:
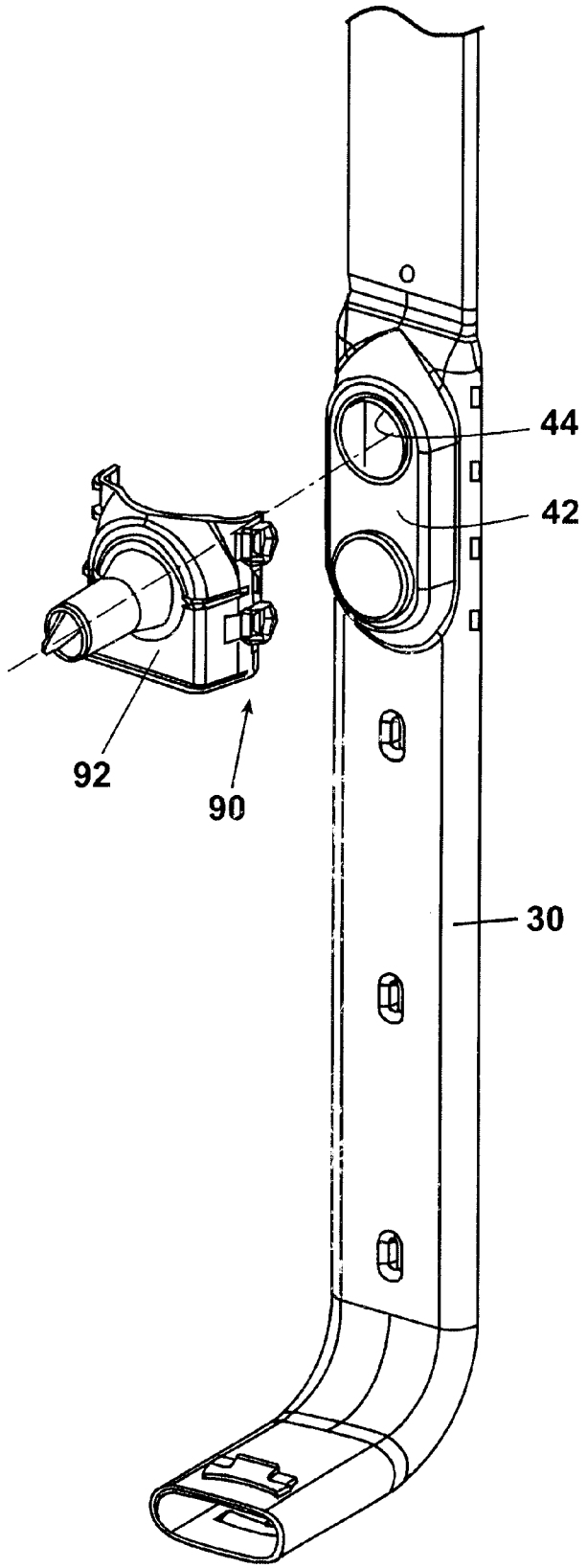
FIG. 6 is a perspective view of a single height coupling system which can be provided on the supply tube of the present invention.

FIG. 6 illustrates a single position coupling assembly 90. In this embodiment, only a single outlet opening 44 is provided in the manifold portion 42. A coupling retainer 92 is snap connected to the manifold 42 for engagement with a feed tube assembly (not shown).

The present invention, therefore, provides for a unique coupling assembly which provides for coupling an adjustable height spray arm system to an internal supply tube. The coupling arrangement is simple and cost effective. The present invention further provides a single or multiple port coupling arrangement using a common supply tube design.

The present disclosure describes preferred embodiments of the invention, however, the invention is not limited to these embodiments. For example, the coupling ports are shown as funnel shaped but could readily be configured in a different manner. The coupling retainer could have a plurality of ribs which direct the coupling end to coupling ports which are mere openings provided in the coupling retainer. Other variations may be made from the described preferred embodiments which are contemplated to be within the spirit and scope of the invention as set forth in the appended claims.

What is claimed is:

1. A dishwasher, comprising:

a tub having a sump and a side wall;

a pump fluidly connected with the sump;

at least one adjustable height basket supported within the tub and arranged to be pulled out of the tub and inserted back into the tub;

a supply tube extending adjacent the tub side wall and receiving wash liquid from the pump, the supply tube having a manifold portion formed into the supply tube including a plurality of outlet openings;

a coupling retainer, connected to the supply tube and having a plurality of coupling ports corresponding in number and spacing to the outlet openings of the supply tube, the coupling ports having, center openings;

a gasket member having a plurality of openings that generally align with the coupling ports wherein each of the openings forms a sealing surface;

a valve member supporting a plurality of flapper valve elements for closing the coupling ports and disposed adjacent the gasket member such that said flapper valve elements close against said gasket, said valve member and said gasket being captured between the coupling retainer and the supply tube such that the gasket opening sealing surfaces and flapper valve elements generally align with the coupling ports;

a spray arm mounted to the adjustable height basket and having a feed tube extending toward the supply tube, the feed tube having a coupling end, the coupling end arranged to be inserted into one of the coupling ports for fluidly connecting the feed tube to the supply tube when said basket is inserted into said tub, wherein the coupling end is sealingly engaged by the sealing surface upon insertion into one of the coupling ports and opens the flapper valve element corresponding to the coupling port into which the coupling end is inserted.

2. The dishwasher according to claim 1 wherein the connection of the coupling retainer to the manifold portion of the supply tube is a snap connection via a plurality of snap hooks and ribs.

3. The dishwasher according to claim 1, wherein the manifold portion is formed with a plurality of closed protrusions which are selectively opened to form the plurality of outlet openings.

4. The dishwasher according to claim 1 wherein the feed tube includes a finger extending beyond the coupling end for insertion into one of the coupling ports and opening one of the valve elements.

5. The dishwasher according to claim 1 further comprising:

a hanging support element extending downwardly from the adjustable height basket and engaging the coupling end of the feed tube such that the coupling end is securely located relative to the adjustable height basket.

6. The dishwasher according to claim 5, wherein the hanging support includes a U-shaped portion which is received into a slot formed into the coupling end.

7. The dishwasher according to claim 5 wherein the feed tube further comprises:

a connecting element which forms the coupling end, the connecting element being connected to the hanging support.

8. The dishwasher according to claim 1 wherein the coupling ports are generally funnel shaped.

9. A dishwasher, comprising:

a tub having a sump and a side wall;

a pump fluidly connected with the sump;

at least one adjustable height basket supported within the tub and arranged to be pulled out of the tub and inserted back into the pub;

a supply tube supported adjacent the tub side wall and receiving wash liquid from the pump, the supply tube having a manifold portion formed into the supply tube including a plurality of closed protrusions which are selectively opened to form one or more outlet openings;

a coupling retainer connected to the supply tube and having one or more funnel shaped coupling ports corresponding in number and spacing to the outlet openings of the supply tube;

a valve member supporting one or more flapper valve elements corresponding in number and spacing to the outlet openings of the supply tube for closing the coupling ports;

a gasket member having one or more openings corresponding in number and spacing to the outlet openings of the supply tube wherein each of the openings forms a sealing surface, the valve member disposed adjacent the gasket member such that said flapper valve elements close against said gasket, said valve member and said gasket member being captured between the coupling retainer and the supply tube such that the flapper valve elements and gasket opening sealing surfaces generally align with the coupling ports;

a spray arm mounted to the adjustable height basket and having a feed tube extending toward the supply tube, the feed tube having a coupling end, the coupling end arranged to be inserted into one of the coupling ports for fluidly connecting the feed tube to the supply tube when said basket is inserted into said tub; and a hanging support element extending downwardly from the adjustable height basket and engaging the coupling end of the feed tube such that the coupling end is securely located relative to the adjustable height basket, wherein the coupling end is sealingly engaged by the sealing surface upon insertion into one of the coupling ports and opens the flapper valve element corresponding to the coupling port into which the coupling end is inserted.

10. The dishwasher according to claim 9, further wherein the gasket member is formed as an integral part of the coupling retainer.

11. The dishwasher according to claim 9 wherein the connection of the coupling retainer to the manifold portion of the supply tube is a snap connection via a plurality of snap hooks and ribs.

12. The dishwasher according to claim 9 wherein the feed tube includes a finger extending beyond the coupling end for insertion into one of the coupling ports and opening one of the valve elements.

13. The dishwasher according to claim 9, wherein the hanging support includes a U-shaped portion which is received into a slot formed into the coupling end.

14. The dishwasher according to claim 13 wherein the feed tube further comprises:

a connecting element which forms the coupling end, the connecting element being connected to the hanging support.

* * * * *